US005580361A

United States Patent [19]

Ferges

[11] Patent Number: 5,580,361

[45] Date of Patent: Dec. 3, 1996

[54] GAS CONDITIONER APPARATUS

[75] Inventor: Johnnes Ferges, Berg. Gladbach, Germany

[73] Assignee: American High Temp., Inc., Manchester, N.H.

[21] Appl. No.: 605,640

[22] Filed: Feb. 22, 1996

Related U.S. Application Data

[63] Continuation of Ser. No. 214,682, Mar. 16, 1994, abandoned.

[51] Int. Cl.[6] ..... C10J 3/84

[52] U.S. Cl. ..... 48/128; 48/76; 48/87; 55/434; 55/462

[58] Field of Search ..... 48/128, 76, 77, 48/87, 111, 209, DIG. 1, 63, 107, 61, 62 R, 203; 422/147, 239; 110/216, 217; 55/307, 396, 434, 462, 465, 398, 413, 445

[56] References Cited

U.S. PATENT DOCUMENTS

| | | | |
|---|---|---|---|
| 1,499,437 | 7/1924 | Adams | 55/307 |
| 2,455,561 | 12/1948 | Creelman | 55/465 |
| 2,634,198 | 4/1953 | Kalbach | 48/202 |
| 3,543,700 | 12/1970 | Baigas, Jr. et al. . | |
| 3,658,482 | 4/1972 | Evans et al. . | |
| 3,951,082 | 4/1976 | Leggett et al. . | |
| 4,145,979 | 3/1979 | Lilley et al. | 110/210 |
| 4,334,484 | 6/1982 | Payne et al. | 110/210 |
| 4,453,474 | 6/1984 | Lewis | 110/188 |
| 4,456,455 | 6/1984 | Shoebotham | 48/76 |
| 4,504,291 | 3/1985 | Haddad et al. | 55/462 |
| 4,520,760 | 6/1985 | Covell | 48/77 |
| 4,616,572 | 10/1986 | Berthiller | 110/254 |
| 4,718,362 | 1/1988 | Santen et al. | 48/76 |
| 4,764,184 | 8/1988 | Meyer | 48/77 |
| 4,950,308 | 8/1990 | Lang et al. | 48/77 |
| 5,139,535 | 8/1992 | Strickland | 48/76 |
| 5,277,880 | 1/1994 | Sechrist et al. | 422/239 |

FOREIGN PATENT DOCUMENTS

| | | | |
|---|---|---|---|
| 0095011 | 11/1983 | European Pat. Off. | 48/89 |

*Primary Examiner*—Peter Kratz

*Attorney, Agent, or Firm*—William C. Geary, III; Nutter, McClennen & Fish LLP

[57] ABSTRACT

Disclosed is a gas conditioner and a method for treating crude, relatively impure gases produced from a gasification process to yield a relatively clean, tar-free producer gas having an energy value of about 1200 to 1500 Kcal/m$^3$. The gas conditioner comprises a reaction chamber for retaining a fuel supply and containing a cracking reaction. An upper portion of the reaction chamber includes an internal reaction housing which provides a primary reaction zone. The gas conditioner also includes a grate structure for filtering producer gas prior to its exit from the conditioner.

5 Claims, 3 Drawing Sheets

GAS CONDITIONER APPARATUS

This application is a continuation of application Ser. No. 08/214,682 filed on Mar. 16, 1994, now abandoned.

BACKGROUND OF THE INVENTION

The present invention is directed to a gas conditioner, or secondary reactor vessel, for use with a gasification process. More particularly, the invention relates to a secondary reactor vessel for generating a relatively clean producer gas from a crude gas produced by a gasification process.

Gasification processes, particularly updraft gasification and other thermal processes, produce a crude gas that has a relatively low level of purity and includes toxic chemicals and other contaminants. Such a gas typically contains compounds such as carbon monoxide, hydrogen, methane, carbon dioxide, nitrogen and water vapor, and has an energy value of approximately 1,200 Kcal/m$^3$ to 1500 Kcal/m$^3$. Pollutants such as tars, dust, and ash are also present, in relatively high concentrations, in these crude gases. Following a gasification process the crude gas must normally be detared, filtered, purified and cooled before it is used in many energy producing applications.

Alternatively, the crude gases may be passed through a gas conditioner or secondary reactor vessel where they are reacted at a relatively high temperature to crack and convert tars and hydrocarbons, thus yielding a more clean gas. Although conventional secondary reactor vessels tend to improve the purity of crude gasification gas, the resultant producer gas still is not at an optimal purity level. Accordingly, there is a need for a secondary reactor vessel which may be used in conjunction with gasifiers, such as updraft gasifiers, to yield a rather pure producer gas, essentially free of tars and hydrocarbons.

It is therefore an object of the present invention to provide a secondary reactor vessel which efficiently converts and cracks tars and hydrocarbons, and which breaks down other complex molecules contained within a crude gas to yield a more clean producer gas. Another object is to provide a secondary reactor vessel which efficiently mixes the crude gas with air or oxygen for the reaction process. It is also an object to provide reactor components that are useful with other gasifier reactor designs. Other objects will be apparent to those skilled in the art upon reading the following disclosure.

SUMMARY OF THE INVENTION

The present invention is directed to a gas conditioner or secondary reactor vessel for use in association with a gasification reactor, such as an updraft or fluidized bed gasifier. Gasification produces a crude, somewhat dirty gas containing carbon monoxide, hydrogen, methane, carbon dioxide, nitrogen and water vapor, as well as particulate pollutants such as tars, dust, and ash. Such a gas has an energy value of approximately 1,200 to 1500 Kcal/m$^3$. The gas converter of the present invention receives the crude gas generated by gasification and cracks the entrained tars and hydrocarbons, converting them to hydrogen, methane and carbon monoxide, to yield a relatively clean producer gas which may then be channeled to an engine or gas turbine to produce electricity, or to a burner to generate heat.

According to the invention, the gas conditioner comprises a reaction chamber for retaining a fuel supply and for containing a cracking reaction. The reaction chamber preferably is substantially cylindrical in shape, having boiler grade, or heat resistant, steel walls which preferably are at least partially lined, with a refractive material such as ceramic. An upper portion of the chamber has an inlet conduit for receiving a crude gas from a gasification process and an inlet conduit for receiving process air. These conduits extend through the walls of the vessel and communicate with an internal reaction housing which mixes the air and crude gas and provides a primary reaction zone for the crude gas and process air.

Preferably, the internal reaction housing extends within the interior of the reaction chamber and is generally conical in shape, having its apex toward the top of the vessel and a bottom portion which is open to the bottom of the vessel. The housing preferably has a double-walled structure. The outer wall preferably is solid, while the inner wall features a number of perforations, at its bottom portion, which communicate with the interior of the housing. The perforations may be present in a single row at the bottom of the inner wall of the housing. The air inlet conduit communicates with the space defined by the inner and outer wall of the housing. The air is delivered to the interior of the chamber through the perforations in the inner wall. The raw gas inlet conduit communicates with and delivers a gas produced by a gasification process to the upper, interior portion of the housing which is defined by the inner wall of the housing. A baffle maybe utilized to disperse the entering gas and/or induce directional (e.g., rotational) flow in the gas. Within the interior housing, the process air and the crude gas become mixed and react.

A fuel source, preferably coke, is disposed within the reaction chamber of the secondary reactor vessel. This chamber may also include a rotatable grate structure disposed at the bottom of the vessel upon which the fuel and ash may rest. A steam/air mixture, oxygen, or another burnable gas may be injected into the gasifier from the vicinity of the rotatable rate. Additionally, a gas exit grate is housed within the wall of the chamber, spaced a predetermined distance from the midpoint of the reaction chamber. A discharge conduit communicates with the gas exit grate and the combustion chamber to withdraw producer gas from the vessel.

The gas exit grate can also be incorporated, as a separate component, into gasifiers or reactors having designs other than the gasifier reactor described herein.

DETAILED DESCRIPTION OF THE INVENTION

Figure 1:
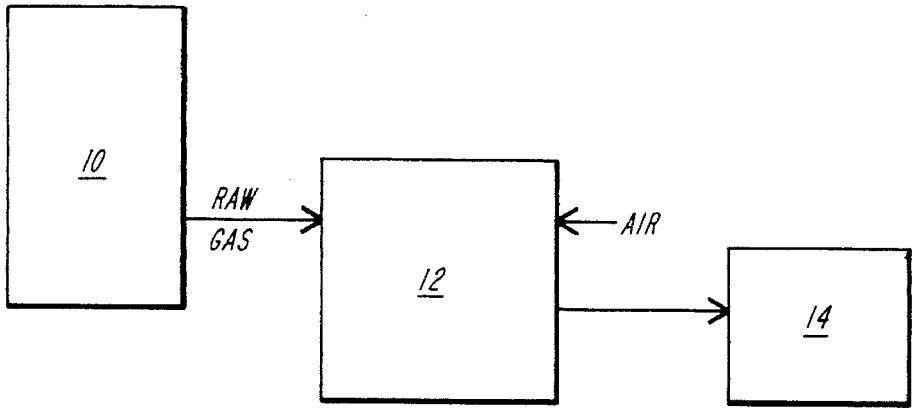
FIG. 1 is a block diagram illustrating the general operation of the gas conditioner of the present invention.

The gas conditioner, or secondary reactor vessel, of the present invention preferably is used in connection with a gasifier system. The gas conditioner of the invention accepts a raw gas, having a relatively high tar, dust and ash content, produced by a gasification reaction and further converts the gas to yield a producer gas substantially free of tars, dust and ash. As shown in FIG. 1, the raw gas from the gasifier 10 is fed into gas conditioner 12 where it is mixed with a process air, oxygen, or an air/steam mixture which is also drawn into conditioner 12. Following combustion within conditioner 12, the resultant producer gas is withdrawn from conditioner 12 and is directed to a further processing station 14, such as an engine, turbine or burner (not shown).

Figure 2:
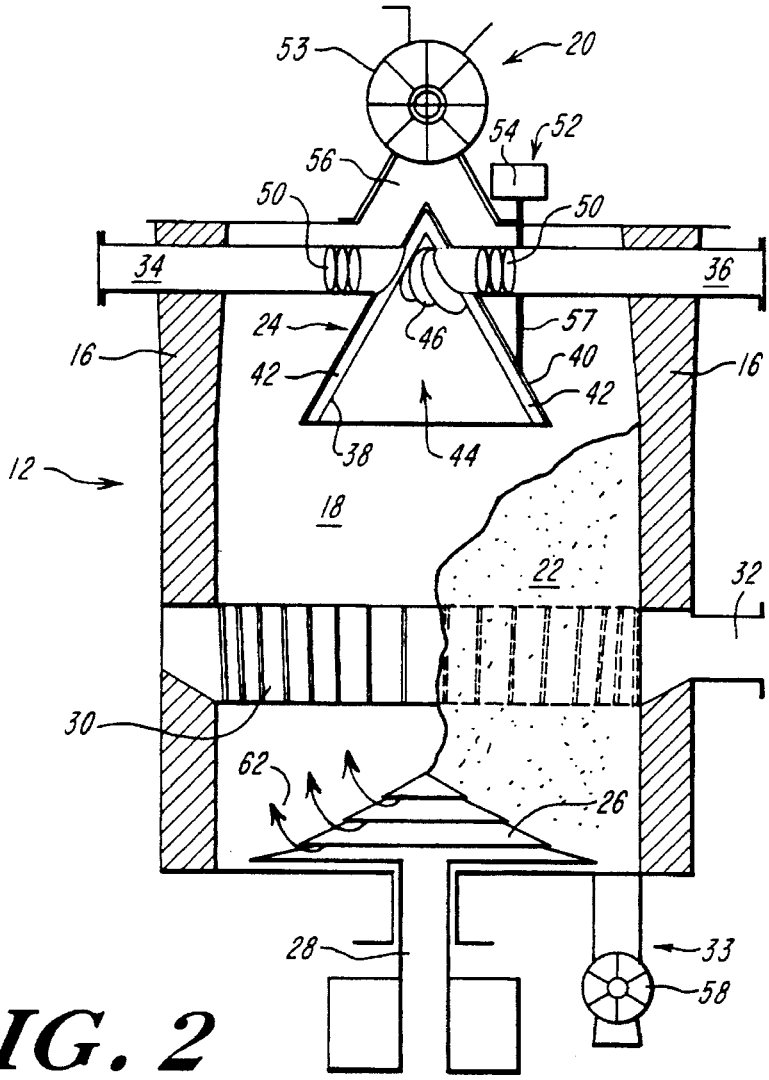
FIG. 2 is a front sectional view of the gas conditioner of the present invention.

Gas conditioner 12, as shown in FIG. 2, is generally cylindrical in shape and is constructed of boiler grade or heat resistant steel walls 16 which define a reaction chamber 18. The interior side walls 16 may preferably be lined with a refractive material (not shown), such as ceramic. A fuel feed mechanism 20 is disposed exterior to conditioner 12, preferably at a top portion thereof, and is adapted to selectively convey a fuel material 22, such as coke, to reaction chamber 18. Other fuel materials such as charcoal or other materials typically used in gas conditioners or gasifiers may be used instead of coke. Preferably the fuel takes the from of relatively small pellets of about 0.5 to 5.0 cm in size.

The reaction chamber 18 of gas conditioner 12 includes an internal reaction housing 24 which is disposed within a top portion of chamber 18. A rotating grate 26 is disposed at a bottom portion of chamber 18. Grate 26 also includes an air supply conduit 28 which communicates air, an airstream mixture, or another gas to chamber 18 through grate 26. Chamber 18 also includes a gas exit grate 30 which is disposed within chamber 18 and preferably extends across the diameter of chamber 18 at a position approximately 10 to 30 inches below the bottom of the internal reaction housing 24. Gas exit grate 30 communicates with a discharge conduit 32, which extends through a sidewall 16 of the vessel for removing producer gas from chamber 18. The conditioner 12 further includes an ash fuel discharge device 33 for removing spent fuel from the vessel.

The walls 16 of secondary reactor vessel 12 are of a thickness sufficient to adequately contain the reaction process which takes place within vessel 12. Preferably, the side, top and bottom walls are 3.8 to 7.6 mm in thickness. Where a refractive lining is applied to the inner surfaces of wall 16, the coating thickness preferably ranges from about 10 to 20 cm. In one embodiment the walls 16 may include cooling conduits (not shown).

The dimensions of secondary reactor vessel 12 may vary depending upon the capacity desired for the apparatus. While the height and diameter of vessel may vary, the volume of chamber 18 may range from 50 to 3,000 $m^3$ per hour throughput. Preferably the height of chamber 18 ranges from 1.0 to 2.5 meters while the diameter of chamber 18 ranges from 0.5 to 3 meters.

As noted above, the chamber 18 is generally cylindrical in shape, however, other known configurations may be utilized for this chamber. In one embodiment, the walls of chamber 18 may be substantially straight such that the diameter of chamber 18 is substantially uniform at all points along its height. Alternatively, the diameter of the chamber may increase uniformly from the top to the bottom of the chamber at an angle of about 2° to 5°. In a preferred embodiment, however, the diameter of the chamber slightly increases from the top of the chamber to a point corresponding to the bottom of housing 24 at an angle of about 2° to 5°. Thereafter, the diameter of chamber 18 may remain uniform. This configuration is preferred as it best enables fuel to gravitate from upper to lower portions of chamber 18.

Figure 3:
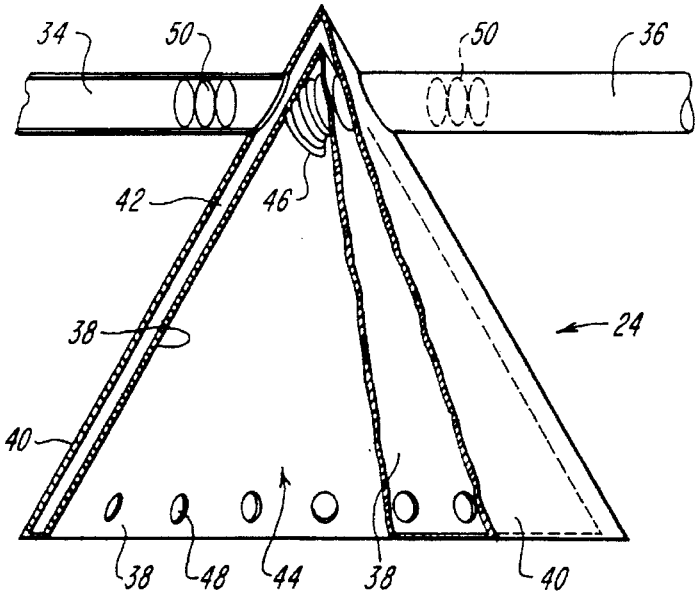
FIG. 3 is a schematic view, partially cutaway, of an internal reaction housing component of the gas conditioner shown in FIG. 2.

The internal reaction housing 24, illustrated in FIGS. 2 and 3, is a generally cone-shaped device which is suspended within a top portion of chamber 18 from raw gas inlet conduit 36 and air inlet conduit 34. Reaction housing 24 comprises inner 38 and outer 40 walls which are separated by a space 42 which may be about 10 to 50 mm. A primary reaction zone 44 is disposed interior of and is defined by interior wall 38.

As shown in FIGS. 2 and 3, raw gas inlet conduit 36 traverses one side wall 16 of vessel 12 and extends through a top portion of reaction chamber 18. Conduit 36 also traverses a top portion of walls 38, 40 of internal reaction housing 24 to enable conduit 36 to deposit raw gas within a top portion of primary reaction zone 44. Preferably, a baffle 46 is disposed at a terminal portion of conduit 36 to impart directional flow, such as rotation, to the incoming gas and to provide for improved dispersion of the gas within zone 44.

Air inlet conduit 34 likewise traverses one side wall 16 of vessel 12 and extends through a top portion of reaction chamber 18 to internal reaction housing 24. Preferably, conduit 34 penetrates outer wall 40 of housing 24 to deposit air (or oxygen) into space 42 of the housing. The air may enter the primary reaction zone 44 through apertures 48 disposed in a bottom portion of inner wall 38. Preferably, apertures 48 are disposed in single row within wall 38. The apertures 48 are generally circular or ovoid and are about 2.5 to 5 cm in diameter. Preferably the apertures have angled nozzles to enable the air to circulate in the same direction as the raw gas.

In one embodiment conduits 34 and 36 may include compensators 50, which are extension joints made, for example, of steel and are designed to allow internal reaction housing 24 to move vertically and horizontally.

A vibrating mechanism 52 may be used in connection with internal reaction chamber 24. Vibrating mechanism 52 includes a motor 54 and a vibrating arm 57 which extends from the motor to a side portion of chamber 24. The vibrating mechanism may be selectively or continuously activated to prevent fuel, added through fuel feed mechanism 20, from adhering to chamber 24.

The inner and outer walls of housing 24 may be constructed of heat resistant steel or other such materials which are compatible with the reaction taking place within housing 24. Alternatively, inner wall may be constructed of heat resistant steel, while outer wall 40 is constructed of boiler grade steel. Preferably, the steel material which makes up housing 24 is about 1.5 to 2.0 cm in thickness. The dimensions of housing 24 may, of course, vary depending upon the overall size of the gas conditioner apparatus. Typically, the diameter of the housing at its base is about 10 to 25 cm less than the interior diameter of the reaction chamber 18. The walls of housing 24 are sloped at an angle of about 45 to 60 degrees.

A gas exit grate assembly 30 is disposed within chamber 18 and extends about the circumference of chamber 18. Grate 30 is suspended from its top portion from wall 16 of chamber 18 and extends for a length of about 0.25 to 0.4 meters. Preferably, the grate 30 is disposed at a location within chamber 18 just below the vertical mid-point of the chamber and adjacent to gas exit conduit 32. The gas exit grate 30 performs a type of filtering function as gas exiting the gas conditioner 12 passes through grate 30 before entering gas exit conduit 32. Some or all of the dust, ash or other particulate matter present in the gas will be prevented from exiting chamber 18 by grate 30.

Figure 5A:
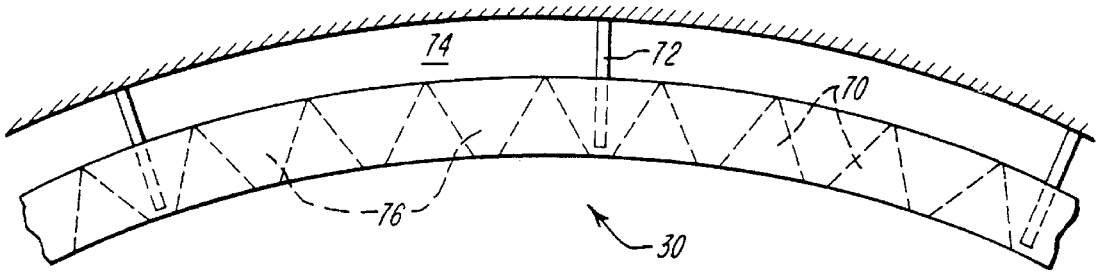
FIG. 5A is a partial top view of the gas exit grate of the gas conditioner of the present invention.
Figure 5B:
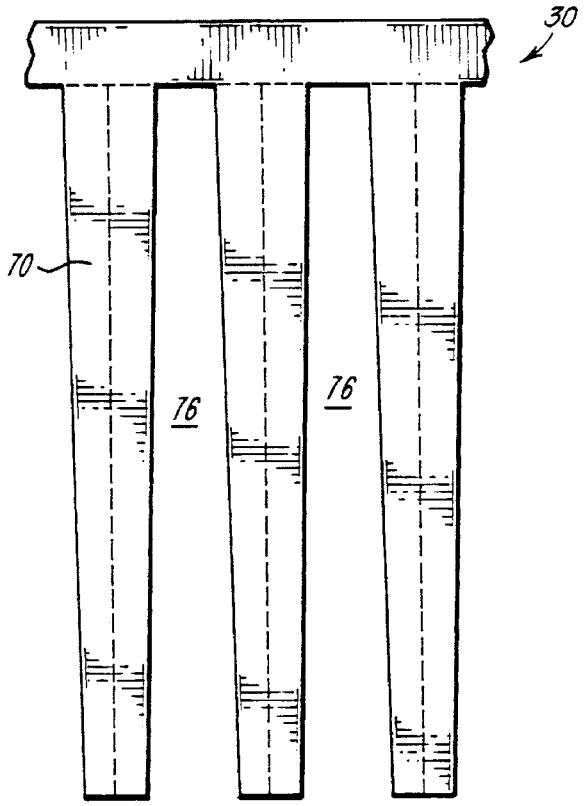
FIG. 5B is a partial side view of a portion of the grate shown in FIG. 5A.
Figure 5C:
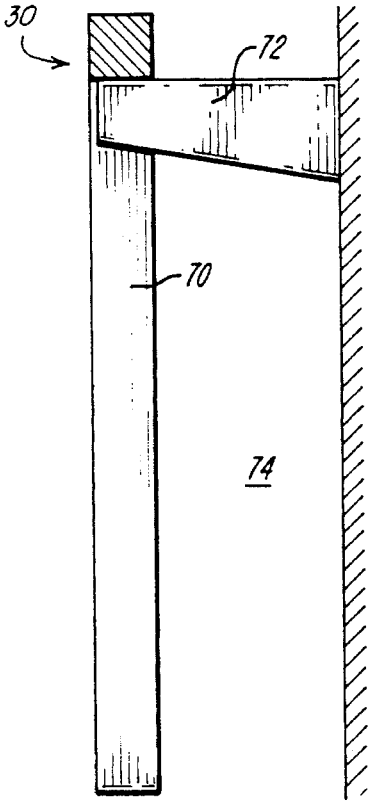
FIG. 5C is a schematic view illustrating the attachment of the grate of FIG. 5A to the inner wall of the gas conditioner.

Referring to FIGS. 5A, 5B and 5C, a plurality of spaced, adjacent rods 70 make up grate 30. A bracket 72, secured to wall 16 of chamber 18, supports a top portion of each of the rods 70 and allows the rods to extent downwardly from the point at which the rods are secured to bracket 72. Wall 16 and rods 70 define an annular space 74 which communicates with gas exit conduit 32.

The rods 70 have a generally triangular cross section with each side of the rod having a width of about 6 to 7 mm. Rods 70 are configured such that each rod is wider at its top portion and narrower at its bottom portion. Conversely, a gap 76, which is defined by adjacent rods 70, is narrower at its top portion and wider at its bottom portion. The amount of taper for both rods 70 and gaps 76 ranges from a wider dimension of about 6 mm to a narrower dimension of about 4 min. Preferably each rod has a length of about 300 mm as measured from its point of attachment at bracket 72 to its bottom end.

Gas exit grate assembly 30 is useful as a component of gasifier or reactor systems that have different designs and constructions than gas conditioner 12 disclosed herein. Other components of gas conditioner 12 may also be used with other gasifier or reactor designs independent of the gas conditioner 12 described herein.

The bottom of chamber 18 features a rotary grate 26 which serves to break-up large particles of spent ash and to facilitate removal of spent ash by discharge screw 58 of ash discharge device 33. A supply conduit 28 is disposed below and exterior to chamber 18 to communicate air, oxygen, or an air/steam mixture into chamber 18 through grate 26.

A fuel material 22, preferably coke, is disposed within chamber 18, filling the chamber to a level corresponding approximately to the middle of housing 24. The fuel 22 may be added to chamber 18 through a fuel feed mechanism 20 mounted on a top portion of vessel 12. Fuel is transferred from a hopper or other storage means (not shown) to a rotary drum 53. As fuel fills one section of the drum 53, the drum rotates and deposits fuel within a top portion of vessel 12 through fuel passage 56. Spent ash is preferably withdrawn from vessel 12 through a discharge screw 58 disposed at the bottom of vessel 12. The fuel level may be controlled manually, or in a preferred embodiment by an automated means which adds additional fuel in response to a signal from a fuel level indicator.

As noted above, the gas conditioner 12 of the present invention is designed to be used in conjunction with a gasifier 10. Gas conditioner 12 accepts a raw gas from the gasifier 10 and further purifies the gas by burning off and removing associated tars and ashes.

Virtually any gasifier may be used in connection with the gas conditioner of the invention. However, updraft gasifiers would more commonly be used with vessel 12 as such gasifiers tend to produce a raw gas having a greater content of tars and dust. The gasifier may be designed so as to burn virtually any known gasification fuel material, including those having a moisture content as high as about 50–60% with an ash content as high as 30% as the gas conditioner of this invention has the capacity to eliminate a high level of impurities from a raw gas. Potential fuel materials which may be combusted within gasifier 10 include wood, sludge, trash, coal and others. Sludge-based materials are a preferred fuel source. Typically, as much as one to three tons of fuel material may be processed per hour with the present gas conditioner and a gasifier.

In operation, the gas conditioner 12 receives raw gas from gasifier 10. Typically, the raw gas has a heat value of about 1,200 to 1,500 Kcal/m$^3$. Additionally, the raw gas comprises about 5% carbon dioxide, 30% carbon monoxide, 13% hydrogen, 2% methane and about 50% nitrogen. Typically the tar content of such gas is about 100 grams/m$^3$ and the dust content is about 200 grams/m$^3$.

Figure 4:
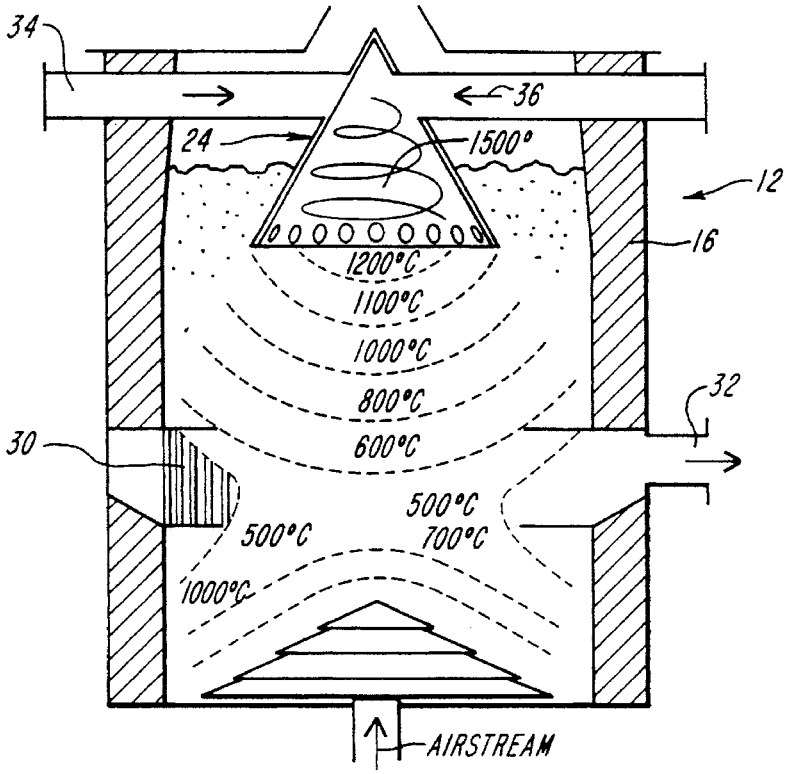
FIG. 4 is a schematic view, partially cut away, of the reaction chamber of the gas conditioner illustrated in FIG. 2, showing temperature zones within the chamber.

The process air (or oxygen) enters conditioner 12 through conduit 34 and is directed into space 42 of internal reaction housing 24. Simultaneously, raw gas is fed into the primary reaction zone 44 of housing 24. As the air (or oxygen) enters the primary combustion zone 44 through apertures 48 it becomes mixed with the raw gas. At the same time, combustion of fuel 22 is occurring within chamber 18. The reaction process within chamber 18 results in temperatures within the reaction zone 44 being in the range of 1,200°–1,500° C. Temperatures within chamber 18 are highest adjacent the bottom of internal reaction housing 24. As illustrated in FIG. 4, temperatures within chamber 18 at an area adjacent to internal reaction housing 24 are about 1200° C. and gradually decrease to about 500° C. at an area adjacent grate 30. Below grate 30 the temperatures gradually rise to about 1000° C. adjacent grate 26. This causes a combustion reaction of the raw gas and the process air within zone 44 which cracks the tars and hydrocarbons contained in the raw gas. The producer gas from zone 44 is drawn downwardly into chamber 18 and through coke fuel 22. A further reaction takes place between the coke fuel and the reaction gas, yielding hydrogen and carbon monoxide.

A gas such as air or an air/steam mixture is added through rotary grate 26 and rises with additional air through the fuel 22 within chamber 18. Such a gas causes gasification of the coke fuel on the surface of grate 26, and the gas produced by this reaction also rises within chamber 18.

The resultant producer gas traverses through chamber 18 to a position interior of gas exit grate 30. From this location the producer gas traverses grate 30 by passing through gaps 76 to annular space 74. The producer gas which enters annular space 74 is free of particulate matter, such as fuel, ash and dust, which is too large to pass through gaps 76. The producer gas entering annular space 74 is drawn out of the gas conditioner 12 through gas exit conduit 32. The exiting gas may then be transferred to a further processing station 14, such as a boiler or generator, where it may be utilized as an energy source.

The exiting reaction gas typically has a heat value of about 1200 Kcal/m$^3$. However, the heat value of this gas may be increased to about 2000 Kcal/m$^3$ by adding additional oxygen to the process air, or by replacing the process air with pure oxygen. Moreover, the reaction gases comprise approximately 8.5% carbon dioxide, 22% carbon monoxide, 13% hydrogen, 2.5% methane and about 54% nitrogen.

It is understood that certain aspects of the invention described above may be modified by one of ordinary skill in the art without departing from the scope of the invention. For example, the dimensions of the gasifier may be somewhat altered from what is described herein. Also, a variety of fuel materials may be used within the gas conditioner of the invention, and, likewise, the raw gas which is reacted within the gas conditioner may be of a make-up somewhat different than what is stated above. The components of the gas conditioner described herein may be used individually, or in combination, with other gasifiers or reaction vessels.

What is claimed is:

1. A gasifier, comprising an internal reaction chamber having means for supporting a bed of fuel therein, and having a gas outlet conduit communicating therewith, the gas outlet conduit being formed in a side wall of the reaction chamber above the bed support means and being effective to remove a producer gas from within the reaction chamber; and a filtering grate means for filtering a producer gas prior to the producer gas exiting the internal reaction chamber through the gas outlet conduit, the filtering grate means having a plurality of spaced, vertically oriented rods circumferentially spaced about the interior of the internal reaction chamber such that an annular gap is formed between the filtering grate means and the side wall of the reaction chamber, the rods being substantially uniformly vertically positioned such that at least some of the spaced rods are adjacent to the gas outlet conduit, and wherein the spaced rods define gaps therebetween through which the producer gas passes to exit the gasifier to filter the gas passing through the spaced rods.

2. The gasifier of claim 1 wherein the rods of the filtering grate means are tapered so as to have a bottom portion slightly narrower than a top portion thereof.

3. The gasifier of claim 1 wherein a top portion of each rod of the filtering grate means is attached to and suspended from an annular rim which supports the rods via a bracket attached to the side wall of the reaction chamber.

4. The gasifier of claim 3 wherein the filtering grate means is constructed such that the space between adjacent rods is narrower at an end adjacent to the annular rim and is wider at an opposite end.

5. The gasifier of claim 3 wherein the filtering grate means is constructed such that each rod is wider at the end attached to the annular rim and is narrower at the opposite end thereof.

* * * * *